United States Patent [19]

Brandl

[11] 4,270,700

[45] Jun. 2, 1981

[54] SECTORAL WATER SPRINKLER

[76] Inventor: Gerhard Brandl, Leonhardstrasse 79, A-80109 Graz, Austria

[21] Appl. No.: 56,779

[22] Filed: Jul. 11, 1979

[30] Foreign Application Priority Data

Jul. 18, 1978 [AT] Austria ..... 5214/78

[51] Int. Cl.[3] ..... B05B 3/04

[52] U.S. Cl. ..... 239/231

[58] Field of Search ..... 239/230–233, 239/505–511

[56] References Cited

FOREIGN PATENT DOCUMENTS

| | | | |
|---|---|---|---|
| 609580 | 8/1956 | Fed. Rep. of Germany | 239/232 |
| 1153202 | 8/1963 | Fed. Rep. of Germany | 239/233 |
| 706405 | 5/1966 | Italy | 239/230 |
| 277898 | 12/1951 | Switzerland | 239/233 |
| 319467 | 4/1957 | Switzerland . | |
| 206237 | 1/1968 | U.S.S.R. | 239/230 |

*Primary Examiner*—Robert W. Saifer

*Attorney, Agent, or Firm*—Kurt Kelman

[57] ABSTRACT

A sectoral sprinkler comprises a standpipe and a pair of abutments projecting therefrom and adjustable to define therebetween a changeable angle determining a sector. A water transmitting pipe carrying a water spray nozzle is mounted rotatably on, and in communication with, the standpipe for rotation in a horizontal plane and is driven in a forward direction towards one abutment by water pressure in the pipes. A shifting rod is rotatably mounted on the water transmitting pipe and extends therealong for rotation about an axis transverse to the standpipe. A return blade is mounted on an outer end of the shifting rod projecting beyond the outer shifting rod end. A coil spring is affixed with one end to the shifting rod and has a free end extending from the water transmitting pipe into the sector whereby a sectoral sweep of the water transmitting pipe and nozzle is defined. The return blade is configurated and arranged to pass into and out of the path of the water jet dispensed from the nozzle during each sweep between the abutments.

1 Claim, 13 Drawing Figures

SECTORAL WATER SPRINKLER

The present invention relates to improvements in sectoral water sprinklers.

A known sectoral water sprinkler comprises a substantially vertical standpipe arranged to receive a stream of water under pressure, a pair of abutments projecting from the standpipe and adjustable for defining therebetween a changeable angle determining a sector, a water transmitting pipe mounted rotatably on, and in communication with, the standpipe for rotation in a substantially horizontal plane, the water transmitting pipe having a section extending from the standpipe in a plane upwardly oblique to the horizontal plane and being driven in a forward direction towards a first one of the abutments by the water pressure, and a water spray nozzle mounted on an outer end of the water transmitting pipe section and dispensing a jet of water when the stream of water under pressure is received in the standpipe and transmitted therefrom through the water transmitting pipe. A return pendulum movement driving the water transmitting pipe section in a reverse direction towards the second abutment includes a shifting rod rotatably mounted on the water transmitting pipe and extending therealong for rotation about an axis transverse to the vertical standpipe, the shifting rod having an outer end projecting beyond the water spray nozzle and a return blade mounted on the outer shifting rod end, the return blade being configurated and arranged to pass into and out of the path of the water jet during each sweep of the water transmitting pipe and nozzle between the abutments. In this type of sprinkler, the shifting rod cooperates with the abutments so that the sweep is reversed at the ends of the forward and reverse drive. During the sweep, the return blade is moved towards the edge of the water jet and is pulled into its path. The impact of the water jet on the return blade generates a torque to cause reversal of the sweep direction. The cooperation of the shifting rod with the respective abutments defining the end points of the sweep cause the return blade to be removed from the path of the water jet. This requires, however, a certain impetus which may not be available when the water pressure is low and the speed of the sweeping movement is correspondingly reduced so that the sweep of the water transmitting pipe, in fact, is not reversed and it comes to a stop.

It is the primary object of this invention to improve a sectoral sprinkler of the described type so that its sweep will not be interrupted even when its speed is low.

The above and other objects are accomplished according to the invention with a spring element affixed to the shifting rod. The spring element has a free end extending from the water transmitting pipe into the sector determined by the pair of abutments whereby the sectoral sweep of the water transmitting pipe and nozzle is defined. When the spring element contacts a respective abutment, the water transmitting pipe first continues for a certain distance in the reverse direction. This loads the spring element and stores sufficient energy therein to cause the shifting rod to pull the attached return blade out of the path of the water jet even if the water transmitting pipe rotates very slowly during the reverse sweep. Therefore, stoppage of the sprinkler sweep is dependably avoided. Since the conventional shifting lever is merely replaced by a spring element affixed to the shifting rod, little additional material or structural effort is required and the improvement may be readily built into existing sprinklers.

The above and other objects, advantages and features of the present invention will become more apparent from the following detailed description of a now preferred embodiment thereof, taken in conjunction with the accompanying schematic drawing wherein FIG. 1 is a side elevational view of a sectoral water sprinkler showing the shifting rod arrangement of this invention;

Figure 1:
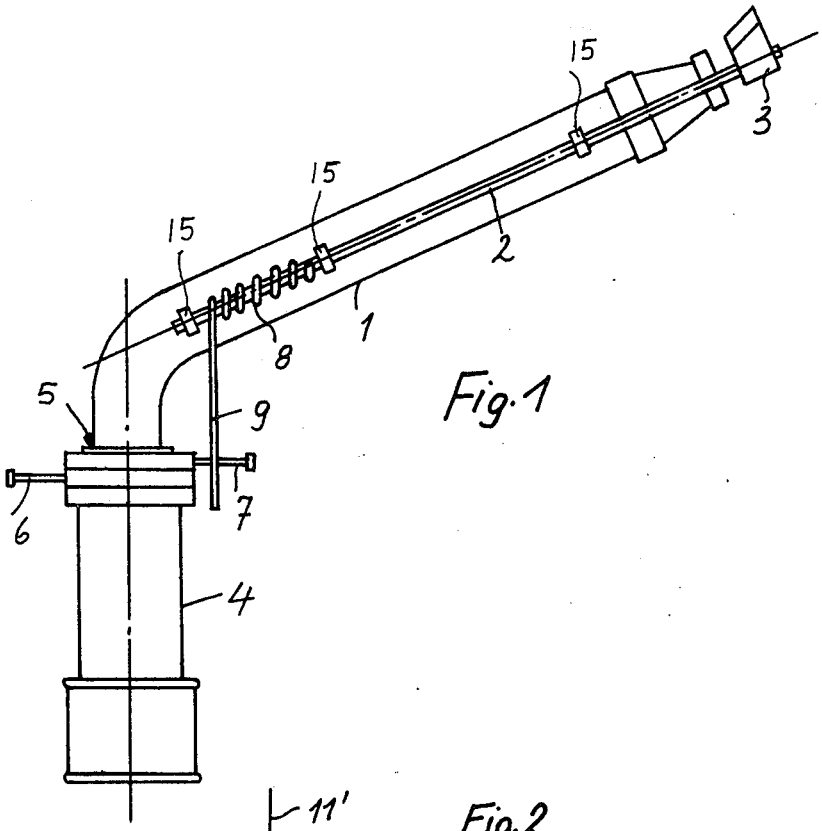

Referring now to the drawing and first to FIG. 1, there is schematically shown a generally conventional type of sectoral water sprinkler which comprises vertical standpipe 4 arranged to receive a stream of water under pressure from a water source (not shown) which is coupled to the standpipe. A pair of abutments 6, 7 project radially from the standpipe. The abutments are adjustable for defining therebetween a changeable angle determining a horizontal sector whose apex is in the vertical axis of standpipe 4. Water transmitting pipe 1 is mounted rotatably at 5 on, and in communication with, standpipe 4 for rotation about the vertical axis in a substantially horizontal plane. As shown, the water transmitting pipe has a section extending from the standpipe in a plane upwardly oblique to the horizontal plane and is driven in a manner well known in sprinklers in a forward direction towards abutment 7 by the water pressure, coupling 13 incorporating the conventional mechanism for rotating the water transmitting pipe about the vertical axis under the pressure of water delivered into standpipe 4.

Water spray nozzle 14 is mounted on an outer end of water transmitting pipe 1 and dispenses a jet of water when the streams of water under pressure is received in the standpipe and transmitted therefrom through the water transmitting pipe.

As illustrated in the side view of FIG. 1, shifting rod 2 is rotatably mounted on water transmitting pipe 1 and extends therealong at one side thereof. The shifting rod is rotatably mounted on the water transmitting pipe by means of three brackets 15 wherein shifting rod 2 is journaled for rotation about axis 10 transverse to vertical standpipe 4, the shifting rod having an outer end projecting beyond water spray nozzle 14. Return or sweep reversing blade 3 is mounted on the outer shifting rod end.

According to this invention spring element 8 is affixed to shifting rod 2 and has free end 9 extending from water transmitting pipe 1 into the sector determined by the pair of abutments 6, 7 whereby a sectoral sweep of the water transmitting pipe and nozzle is defined. The illustrated spring element is a coil spring wound about an inner end of shifting rod 2, one of the ends of coil spring 8 being affixed to the shifting rod and the other end being free end 9 forming a lever arm downwardly extending from water transmitting pipe 1 into the sector between the abutments.

Figure 2:
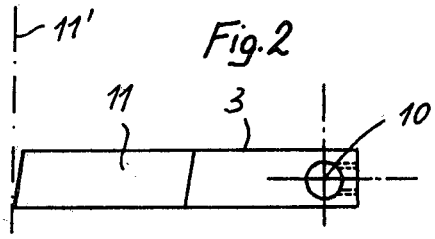
FIG. 2 is a side view of the return or reversing blade.
Figure 3:
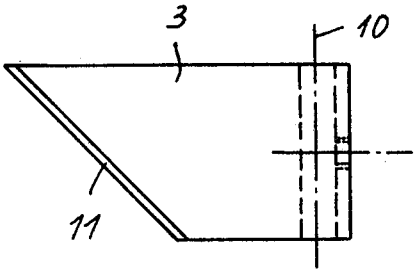
FIG. 3 is a top view of the return or reversing blade.

As best shown in FIGS. 2 and 3, return or sweep reversing blade 3 is configurated and arranged to pass into and out of the path of the water jet during each sweep between abutments 6 and 7. It comprises water jet impact face 11 twice inclined with respect to axis of rotation 10 of sweep shifting rod 2. When blade 3 is rotated into the path of the water jet, the water jet impinges on blade face 11 and causes reaction forces to be described hereinafter.

The size of the sector to be sprinkled is determined by setting the angle between abutments 6 and 7, which may be done by adjusting one or both of the abutments on standpipe 4.

Figure 4:
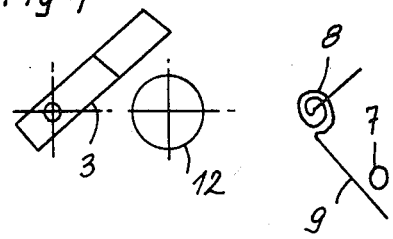
FIGS. 4 to 13 illustrate successive phases of the blade with respect to the water jet emitted from the nozzle and the corresponding changes of the position of the spring element with respect to the pair of abutments, the blade being shown in front veiw.

The successive stages of the forward and reverse sprinkler sweep movements are illustrated in FIGS. 4 to 13. As the sprinkler water transmitting pipe and nozzle are driven in a forward direction, as shown in FIG. 4, blade 3 first remains outside the path of water jet 12. During this stage of the sweeping movement, arm 9 of coil spring 8 approaches abutment 7 which, on contact with the coil spring arm, will cause the water transmitting pipe and nozzle to move in a reverse direction towards abutment 6, this pendulum movement being repeated as long as water is supplied under pressure to standpipe 4.

Figure 5:
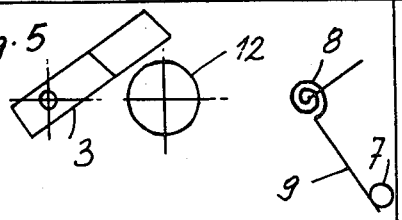
Figure 6:
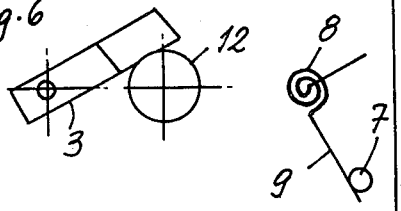
Figure 11:
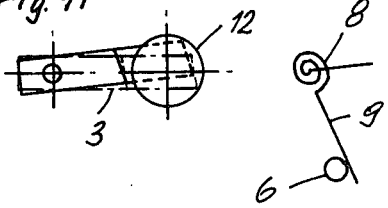
Figure 7:
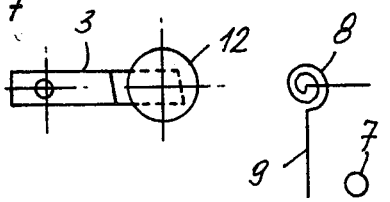

As soon as coil spring arm 9 has reached and contacted abutment 7, as shown in FIG. 5, coil spring 8 affixed to shifting rod 2 will force the same to be rotated, thus causing blade 3 affixed to rod 2 for rotation therewith to be moved in the direction of water jet 12 and finally to be moved gradually into the path of the water jet, as illustrated in FIGS. 6 and 7.

FIGS. 2 and 3 show water jet impact face 11, upon which the water impinges as blade 3 moves into the path of the water jet, to be inclined by 5° to 10° with respect to vertical plane 11' extending substantially parallel to axis 10 and enclosing an angle of about 45° with this axis. The first inclination of face 11 causes water jet 12 to be deflected somewhat upwardly, producing a perpendicular reaction force jerking blade 3 into the path of water jet 12. A stop (not shown) is arranged to hold blade 3 in a position substantially centered in relation to water jet 12, which phase is shown in FIG. 7. During this phase of the movement, coil spring arm 9 has assumed a center position between the abutments and is spaced from abutment 7.

Figure 8:
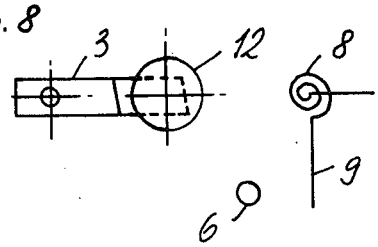

The second inclination of blade face 11 causes the water jet to be laterally deflected so that the resultant reaction force causes the sprinkler water transmitting pipe 1 to be pivoted towards the other side. This assures the reverse sweeping movement during which arm 9 of coil spring 8 approaches the other abutment 6, as shown in FIG. 8.

Figure 9:
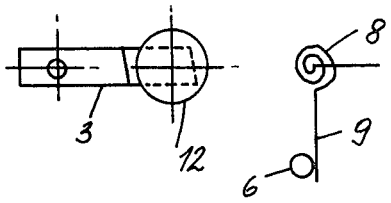

When coil spring arm 9 contacts abutment 6, as illustrated in FIG. 9, the reverse sweeping movement is terminated. In the conventional sprinklers of this general type, coil spring 8 and spring arm 9 are replaced by a lever which is rotatably arranged on the water transmitting pipe and is linked to the shifting rod. When this lever contacts the abutment, the sprinkler movement is reversed with considerable force. This forceful reversal causes the return or sweep reversing blade to be removed from the path of the water jet against the vertical reaction force mentioned hereinabove. The reverse sweep of the sprinkler is thus terminated and the initial position of the sprinkler shown in FIG. 4 is restored.

Figure 10:
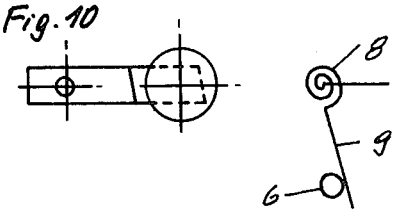

However, in actual operation and particularly if the water pressure is relatively low, the engagement of the lever with the abutment may not produce a sufficient impact and force to reverse the sweeping movement adequately. This will cause the return or sweep reversing blade to be only partially moved out of the path of the water jet, and the blade will remain in a centered position. Thus, the sweeping movement will be halted and this state will not be changed even if the water pressure is increased again. In the arrangement of the present invention, on the other hand, the engagement of spring arm 9 with a respective abutment 6, 7 will tension or load coil spring 8 while water transmitting pipe 1 continues its sweeping movement and blade 3 remains in the path of water jet 12, as seen in FIG. 10. The spring will be further tensioned during the phase illustrated in FIG. 11, the resultant torque operating on blade 3 tending to move the blade out of the path of the water jet. This torque is of the same magnitude as the perpendicular reaction force which holds blade 3 in the water jet path.

Figure 12:
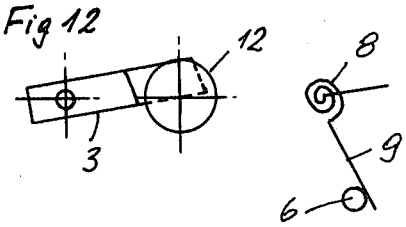
Figure 13:
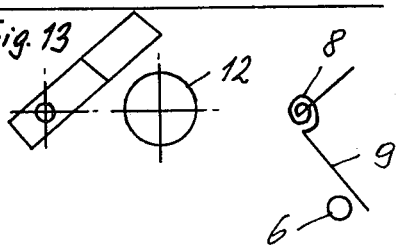

Finally, as seen in FIG. 12, the further sweep of water transmitting pipe 1 in the reverse direction will load spring 8 sufficiently to move blade 3 gradually out of the center of the path of the water jet, in which phase the perpendicular reaction force of the water jet exerted on the blade rapidly decreases so that the spring force of spring 8 becomes fully effective and, as shown in FIG. 13, return or sweep reversing blade 3 is jerked out of the path of water jet 12.

It will be readily appreciated from the above description of the structure and operation of the device that the rapid movement of the return blade out of the path of the water jet will be dependably achieved, regardless of whether the sweeping movement of the sprinkler is fast or slow, due to low water pressure. Whatever the operating conditions, the sweeping movement will never be halted.

What is claimed is:

1. A sectoral water sprinkler comprising (a) a substantially vertical standpipe arranged to receive a stream of water under pressure, (b) a pair of abutments projecting from the standpipe and adjustable for defining therebetween a changeable angle determining a sector, (c) a water transmitting pipe mounted rotatably on, and in communication with, the standpipe for rotation in a substantially horizontal plane, the water transmitting pipe having a section extending from the standpipe in a plane oblique to the horizontal plane and being driven in a forward direction towards a first one of the abutments by the water pressure, (d) a water spray nozzle mounted on an outer end of the water transmitting pipe section and dispensing a jet of water when the stream of water under pressure is received in the standpipe and transmitted through the water transmitting pipe, (e) a shifting rod rotatably mounted on the water transmitting pipe and extending therealong for rotation about an axis transverse to the vertical standpipe, the shifting rod having an inner end and an outer end projecting beyond the water spray nozzle, (f) a return blade mounted on the outer shifting rod end, and (g) a spring element having one end affixed to the inner end of the shifting rod, said one end being a coil spring wound about the inner shifting rod end, and another, free end forming a lever arm extending from the shifting rod into the sector determined by the pair of abutments whereby a sectoral sweep of the water transmitting pipe and nozzle is defined, the return blade being configurated and arranged to pass into and out of the path of the water jet during each sweep between the abutments.

* * * * *